US005309860A

United States Patent [19]

Shearer

[11] Patent Number: 5,309,860

[45] Date of Patent: May 10, 1994

[54] FLEXIBLE HINGE ASSEMBLY

[75] Inventor: Robert R. Shearer, Bradenton, Fla.

[73] Assignee: Aldon Industries, Inc., Bradenton, Fla.

[21] Appl. No.: 954,636

[22] Filed: Sep. 30, 1992

[51] Int. Cl.[5] ..... B63B 17/00

[52] U.S. Cl. ..... 114/361; 49/147; 16/DIG. 3

[58] Field of Search ..... 114/361, 364, 178; 296/92, 84.1, 88, 96.12, 96.13, 89; 49/147; 16/DIG. 13, DIG. 33, DIG. 43, 235, 239, 242; 108/323; 160/368.1

[56] References Cited

U.S. PATENT DOCUMENTS

| | | | |
|---|---|---|---|
| 1,682,993 | 9/1928 | Short | 16/DIG. 33 |
| 2,102,123 | 12/1937 | Leveau | 114/361 |
| 2,355,264 | 8/1944 | Bloomfield | 296/96.13 |
| 3,014,608 | 12/1961 | Aylor | 49/147 |
| 3,843,982 | 10/1974 | Lane | 114/361 |
| 5,111,765 | 5/1992 | Kobayashi | 114/361 |

FOREIGN PATENT DOCUMENTS

| | | | |
|---|---|---|---|
| 615643 | 1/1927 | France | 49/147 |

*Primary Examiner*—Robert J. Oberleitner
*Assistant Examiner*—Clifford T. Bartz
*Attorney, Agent, or Firm*—Howard & Howard

[57] ABSTRACT

The present invention is a flexible hinge for mounting a first panel to a second panel with both the first and second panels having a complex contoured surface. In the disclosed embodiment, the panels are a door panel and the windshield of a boat. The hinge includes brackets mounted to the door panel and the windshield. A flexible pin is inserted into adjoining sockets on the brackets to interconnect them and permit them to pivot with respect to one another. The flexible pin bends as the brackets pivot permitting the brackets to deflect with respect to one another along the longitudinal centerline of the sockets. The preferred flexible pin includes a coil spring and a core pin with the core pin being inserted into the coil spring to increase the shear strength of the coil spring.

23 Claims, 3 Drawing Sheets

64
66
62
68
70
60
75
36
42
26
49
54
56
36
30
46
44
40
42
58
50
38
48
56
40
54
52
38
38
38
64
54
34
54
64
38
30
64
34
38
54
64
5
5

Fig-5
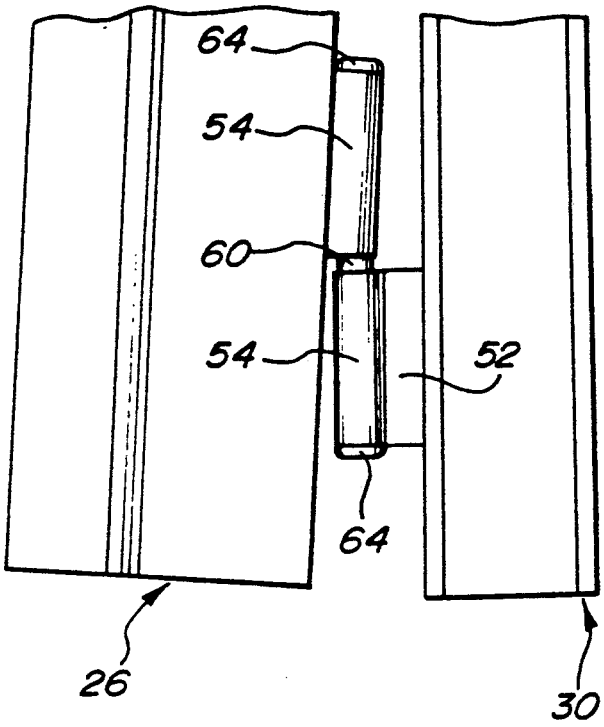
Fig-6
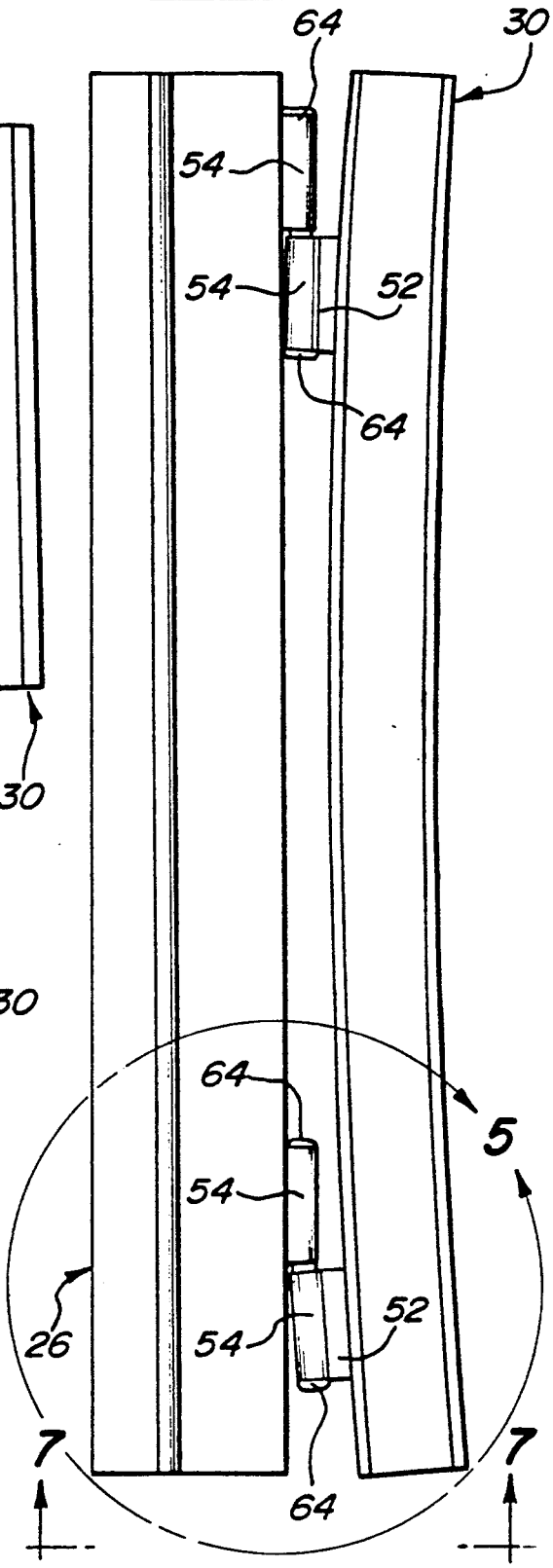
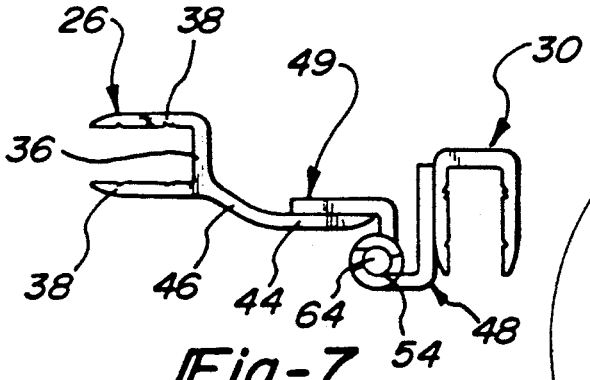
Fig-7

FLEXIBLE HINGE ASSEMBLY

TECHNICAL FIELD OF THE INVENTION

The present invention relates to a hinge assembly that permits two complex contoured surfaces to be pivoted with respect to each other. More particularly, the present invention relates to a hinge assembly that can be used to hinge a door or other panel to a complex contoured boat windshield.

BACKGROUND OF THE INVENTION

As in other industries, the boating industry is stretching the design boundaries to create new and innovative boat designs. One particularly fertile area for boat design innovation is in the design of boat windshields. Traditionally, boat windshields have been flat and only slightly angled with respect to the boat in the direction from its bow to its stern to make them somewhat aerodynamic. The side wings of these windshields were also flat and the connection between the side wings and the front windshield was a straight line. The overall appearance of these traditional boat windshields and the boat itself, due in large part to the appearance of the windshield, was very square.

New designs for boat windshields are very sleek and streamlined. The newest and most innovative windshields have complex contours. The assignee of the present invention, Aldon Industries, is a leader in the design of creative, futuristically appearing windshields having complex contours. Complex contoured windshields are curved to wrap around the boat across its bow and down its port and starboard sides. It is also curved from the base of the windshield to the top of the windshield. To explain it another way, the windshield is curved in two planes. It is curved in a first plane that is parallel to the base of the windshield and it is curved in a second plane that is perpendicular to the base of the windshield.

A problem with complex contoured windshields having dual plane curvature is the difficulty in pivotally mounting complex contoured panels to the complex contoured windshield. The panels may be a window panel that pivots to open or a door panel such as a door panel mounted at the midpoint of the windshield to allow ingress and egress to the bow of the boat. To be acceptable, the panel must open and close smoothly and easily with a tactile swing and it must close flush with the adjoining panel.

A hinge has to be used to pivotally mount these panels so they can freely swing to be opened and closed. With the complex curved surfaces, a standard hinge cannot be used because it is too rigid along a fixed line of pivot. The purpose of a standard hinge pin or pintle is to keep the mating hinge knuckles aligned along the center line so that the swinging panel swings through a predetermined constant arc. This will not work with a complex contoured panel because the contour will not allow the panel to swing along a fixed centerline. The panel will either abut the ajoining fixed panel or the two adjoining panels will have to be separated an unsightly distance to allow room for the panel to swing.

SUMMARY OF THE INVENTION

The present invention overcomes the above problem by providing a hinge that is flexible and flexes as a complex contoured panel is pivoted with respect to a panel such as a windshield.

The flexible hinge of the present invention has a flexible pin which is inserted into adjoining sockets or knuckles of a hinge bracket or leaf to interconnect the brackets permitting the brackets to pivot with respect to one another. The flexible pin bends as the brackets pivot permitting the brackets to deflect with respect to one another along the longitudinal center line of the adjoining sockets. In this way the adjoining complex contoured panels can freely pivot with respect to each other.

In the preferred embodiment, the flexible pin includes a coil spring having a core pin inserted into it. The hinge is used to pivotally interconnect a door panel to a front panel in the windshield of a boat. The door panel and the opening in the windshield have adjoining edges enclosed by first and second channels having the same general contour as the edges. The brackets are mounted to the first and second channels. To cover the brackets so that they are not visible when the door is closed, the first channel includes a face plate. The face plate has an offset that compensates for the thickness of the brackets so that the door panel is flush with the windshield when the door is closed.

In a further embodiment, the flexible hinge is formed of a single plastic rod which is inserted into the knuckles of the hinge. In order to get the needed shear strength and longevity, the single pin would preferably be made of a fiber reinforced plastic such as for example, carbon or kevlar fiber reinforced plastic.

BRIEF DESCRIPTION OF THE DRAWINGS

FIG. 5 is an enlarged view of the circled area of FIG. 6.

FIG. 6 is a side view similar to FIG. 4 illustrating the mounting channels pivoted with respect to one another.

FIG. 7 is a view taken along line 7—7 of FIG. 6.

DETAILED DESCRIPTION OF THE INVENTION

Figure 1:
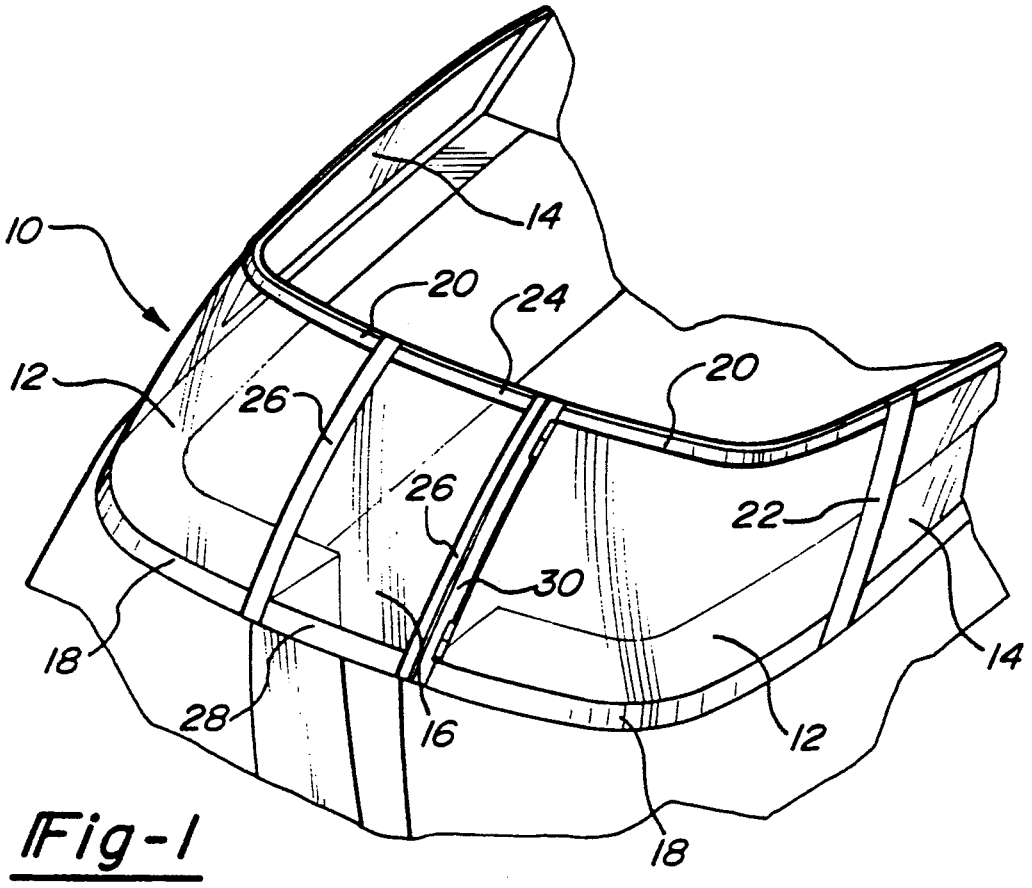
FIG. 1 is a partial perspective view of a boat windshield and a door panel having a complex curvature.

With reference to FIG. 1, a boat windshield is generally shown at 10. The flexible hinge of the present invention will be described with respect to its use on a boat windshield having a complex contour. It should be understood; however, that the flexible hinge of the present invention could be used in other applications that have hinged surfaces with complex contoured surfaces or that require the hinge to flex or deflect along a centerline.

Figure 2:
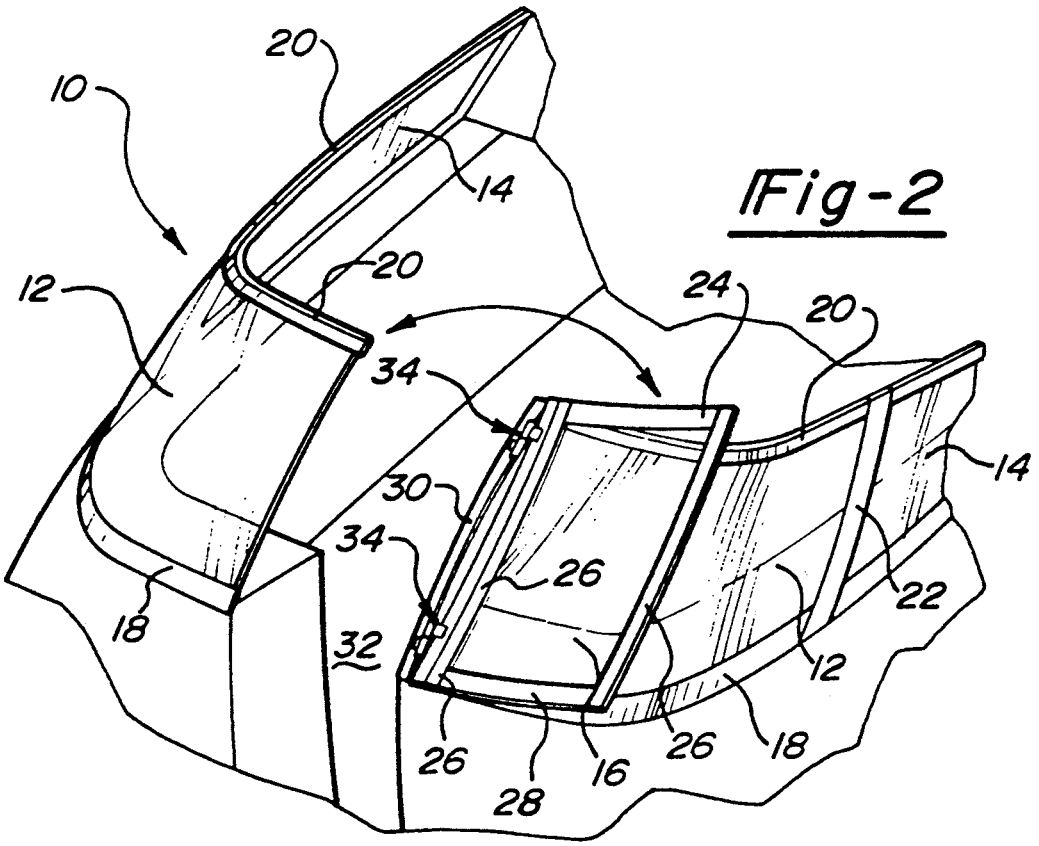
FIG. 2 is a partial perspective view similar to FIG. 1 with the door panel pivoted with respect to the windshield.

As can be seen in FIGS. 1 and 2, the illustrated windshield has a complex contour. The windshield 10 is curved to wrap around the boat across the bow and down its port and starboard sides. It is also curved from footer 10 to header 20. This second curvature can be seen in FIGS. 3, 4, and 6 which shows the end channel 30 and the vertical door channel 26 that cover the edges of the windshield and therefore have the same curvature as the respective windshield or door edge. To explain the curvature another way, the windshield is curved in two planes. It is curved in a first plane that is parallel to the base of the windshield and it is curved in a second plane that is perpendicular to the base of the windshield.

Figures 3, 4:
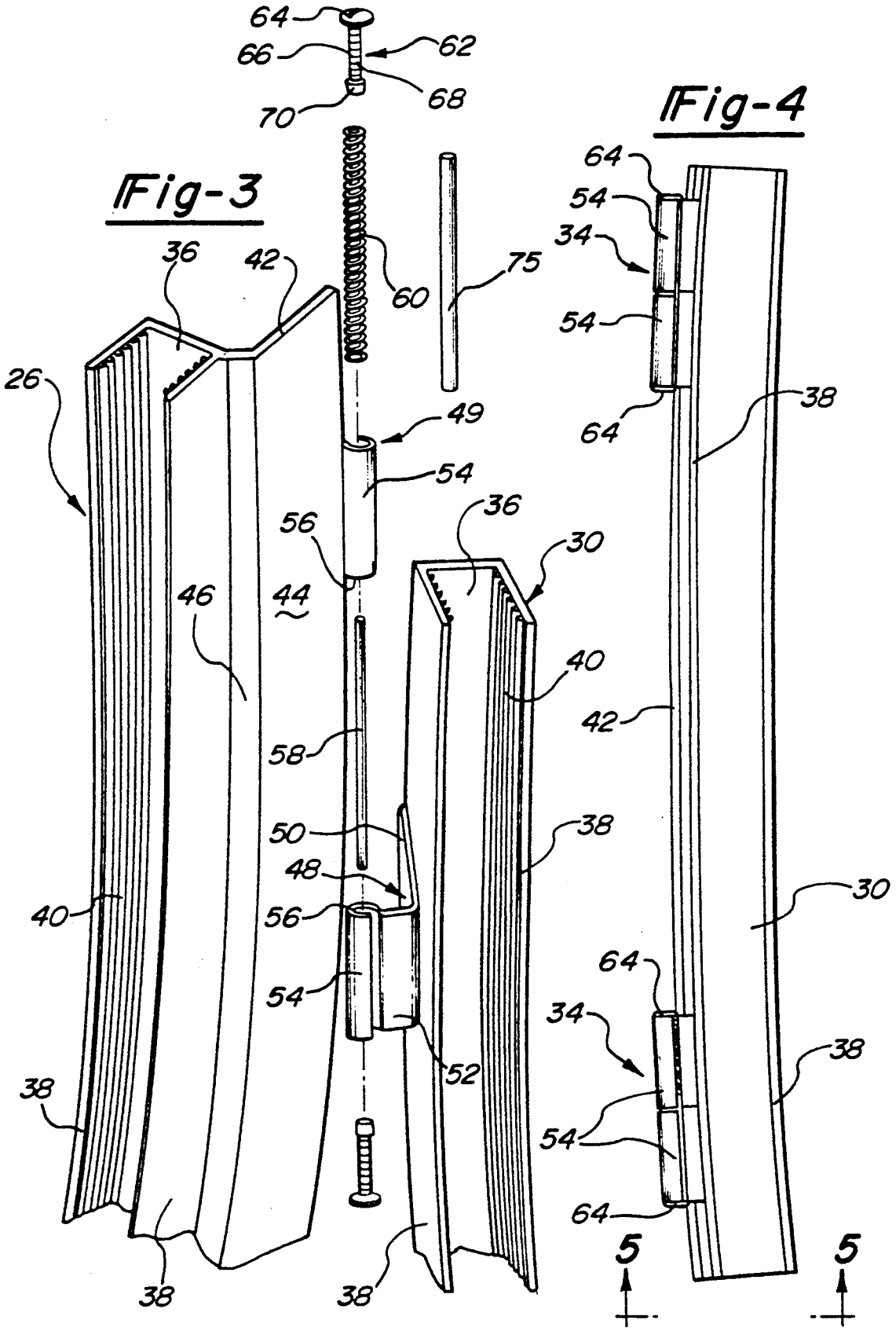
FIG. 3 is a partial perspective view of the flexible hinge of the present invention interconnecting the windshield and door panel mounting channels.
FIG. 4 is a side view of the mounting channels and the flexible hinge of the present invention.

The illustrated windshield 10 has front panels 12, side panels 14 and a door panel 16. The front and side panels are mounted to the boat by a footer or base channel 18. Footer 18 has a flange, not shown, for receipt of fasteners so that it can be fastened to the boat. With reference to FIG. 3, the general configuration of the various channels referred to herein are illustrated. The channels are of typical construction commonly known to those of ordinary skill in the art and have a base 36, sidewalls 30 and gripping teeth or ridges 40. The top of the front panels 12 and side panels 14 are capped by a header 20 of the same basic configuration of the channels. The inner edge of windshield front panel 12 which is at passageway 32 has an end channel 30. Additionally, in the preferred embodiment a vertical channel 22 is provided between the header 20 and the footer 18 to interconnect the front panel 12 to side panel 14. Channel 22 has opposed pairs of sidewalls 38 to engage the edges of the adjoining panels 12 and 14.

The door panel 16 has a header 24, vertical channels 26 and a footer 28. One of the vertical door channels 26, the channel adjacent end channel 30, has an angled flange 42 extending in the direction of channel 30. See FIG. 3. Flange 42 includes a face plate 44 that covers the mounting brackets 48 and 49 of the hinge assembly 34 so that they are not visible when the door panel 16 is closed. Flange 42 also has an offset portion 46 which compensates for the distance added due to the thickness of the brackets 48 and 49. The offset 46 allows the door panel to close flush with front panels 12.

The door panel 16 is mounted to the front panel 12 by flexible hinge assembly 34. In the preferred embodiment, the hinge 34 is mounted to the end channel 30 and the adjacent vertical channel 28 of door panel 16. It should be appreciated that other methods of attaching the hinge 34 are within the scope if the invention, for example, the hinge could be directly attached to the surface of the panels without having the intermediate channels 28 and 30.

With reference to FIGS. 3, 4 and 6, the flexible hinge assembly 34 will be described in greater detail. The hinge 34 has a pair of L-brackets or leafs 48 and 49. Each bracket 48 and 49 includes a base 50, a foot 52, and a generally tube shaped socket of receiver section 54 that forms the knuckles of the hinge 34., The base 50 of bracket 48 is mounted to the sidewall 38 of end channel 30. The base 50 of bracket 49 is mounted to the flange 42 of vertical door channel 26. In the preferred embodiment, the bases 50 are adhesively welded to the sidewall 38 and the flange 42 respectively. The bracket could be mounted by other known means, such as by using fasteners. The bases are mounted so that they are adjacent to one another, and extend in the same direction so that the face plate 44 covers both when the door panel is closed. In the preferred embodiment there are two pairs of the brackets 48 forming two hinges 34.

The foot 52 of each bracket 48 and 49 extends outwardly, generally perpendicular to base 50. At the end of each foot are sockets or knuckles 54 for receipt of a flexible core pin 58, a spring 60 and end caps 64. As illustrated in FIG. 4, each hinge assembly is formed by positioning a pair of knuckles 54 adjacent to one another and connecting them with the flexible core 58, spring 60 and end caps 64. With reference to FIGS. 5 and 6, the flexing of the hinges 34 is illustrated. As the door panel 16 is pivoted the curvature of the door panel and the windshield causes the hinge to deflect or flex with respect to the longitudinal axis of the hinge. If a standard hinge pin were used, there would be no flexing or if there were flexing it would be destructive to the hinge assembly. To obtain the necessary flexing, a flexible core pin 58 and a spring 60 are used. In the preferred embodiment, core pin 58 is made of plastic and the spring 60 is a coil spring made of stainless steel so that it is resistant to corrosion. The core pin 58 is inserted into the coil spring to increase the shear strength of the spring. Without the core pin 58 the spring 60 would likely be plastically sheared due to the weight of the door panel 16 causing an uneven swing of the door and possibly permanent deformation of the spring preventing proper closing of door panel 16. A stiffer spring could be used but if weight is placed on the door, such as someone leaning on the door, it to could be deformed. Further, if to stiff a spring is used, the necessary deflection may not be obtained. In the preferred embodiment a stainless steel extension spring is used having a 3/16 O.D. and a spring rate of 0.283.

In the preferred embodiment of the invention the core pin 58 is secured to the interior of the spring 60 by an adhesive to ensure that it is part of the hinge assembly when the hinge assembly is assembled. To complete the hinge assembly 34, a cap plug 62 is inserted into the spring 60 to retain the spring and core within receiver 54, to give the hinge a finished look, and to protect the interior of the hinge assembly 34 from the elements.

The cap plug 62 illustrated is a plastic panel fastener that has a head 64, a body or stem 66 with flexible flanges 68 extending at substantially right angles to the body 66 and an entry portion 70 that is generally conical and facilitates insertion of plug 62 into spring 60. The flanges 68 have an outer diameter slightly greater that the inner diameter of the spring so that when plug 62 in inserted into spring 60, the flanges 68 are deflected against the inner walls of the spring and urge against the walls to hold plug 62 in the spring 60. In the preferred method of assembly, the plug is first inserted into one end of the spring 60 and then the spring with the core 58 is inserted into the receivers of the adjacent brackets 48 and 49 to couple them together. Thereafter, the remaining cap 64 is inserted into the spring 60 to close the hinge. In the disclosed embodiment, the core pin 58 has a length that is slightly less than the length of the spring 60 to allow plugs 62 to be inserted. As should be appreciated, the cap plug 64 could be inserted into the receiver 54 as opposed to the spring 60 to obtain the same result. Additionally, numerous fasteners could be used to replace the cap plug 62 herein described without deviating from the intended scope of the invention.

Hinge 34 flexes slightly through pin 58 and spring 60 with respect to the center line of the hinge 34 to compensate for the complex contour of the windshield 12 and door panel 16. The door panel 16 freely swings and the tactiles are very good. The combination of the coil spring 60 and the core pin 58 permit regular and repeated deflections of the knuckles 54 without destroying the hinge assembly 34. The combination also provides an inherent memory to the hinge assembly 34 once deflection has occurred to ensure that the door 16 repeatedly swings to the closed position, flush with the windshield 12. As should be appreciated, the plastic pin 58 and the spring 60 will repeatedly return to their normal position once deflected due to the inherent memory of the pin 58 and spring 60.

In a further embodiment of the invention, the spring 60 is not used. Instead, a fiber reinforced plastic pin 75 is used instead of the pin 58 and the spring 60. The pin 75 would preferably be reinforced with carbon or kevlar fibers to increase the shear strength and life of the pin. The caps 62 may not be necessary with the pin 75 since pin 75 could be formed with a radiused top and bottom to give the hinge a finished look. Alternatively, the caps 62 could be used. It should be understood that the pin 75 would have an outer diameter that is just slightly less than the inner diameter of receiver 54, about the same diameter as spring 60, i.e. 3/16 O.D.

It should be understood that the above is an exemplary description of the preferred embodiment of the present invention. Other modifications and variations will be apparent to those of ordinary skill in this art in view of the disclosure of this invention. For example, the flexible hinge is neither limited to mounting a door panel to a boat windshield nor to the boating industry. The hinge disclosed will be useful in any application that requires a hinge having knuckles that deflect or flex slightly as they are pivoted. Further, the various elements may be made of different material as required by the particular application. Other variations will become apparent to those of ordinary skill.

What is claimed is:

1. A flexible hinge for mounting a first panel to a second panel, said hinge comprising:

first and second hinge brackets, said first hinge bracket being mounted to said first panel and said second hinge bracket being mounted to said second panel, said hinge brackets having adjoining openings defined by knuckles with an interior bore;

a flexible pin received within said interior bores to interconnect said first and second brackets, permitting said brackets to pivot with respect to one another, said flexible pin bending as said brackets pivot permitting said brackets to deflect with respect to one another along the longitudinal centerline of said adjoining openings;

whereby the first and second panels can freely pivot with respect to each other; and wherein said first and second panels have a complex contoured surface and said first panel is a windshield and said second panel is a door panel pivotally mounted to an opening in said windshield by said flexible hinge.

2. A flexible hinge for mounting a first panel to a second panel, said hinge comprising:

first and second hinge brackets, said first hinge bracket being mounted to said first panel and said second hinge bracket being mounted to said second panel, said hinge brackets having adjoining openings defined by knuckles with an interior bore;

a flexible pin received within said interior bores to interconnect said first and second brackets permitting said brackets to pivot with respect to one another, said flexible pin bending as said brackets pivot permitting said brackets to deflect with respect to one another along the longitudinal centerline of said adjoining openings;

whereby the first and second panels can freely pivot with respect to each other; and said first panel and said second panel having adjoining edges, said adjoining edges being enclosed within first and second channels having the same general contour as said edges, said first and second brackets being mounted to said first and second channels.

3. A flexible hinge as recited in claim 2, wherein said brackets pivot relative to said flexible pin.

4. The flexible hinge of claim 2, wherein said first channel is mounted to the edge of said first panel and includes a face plate that covers said first and second brackets when said first panel is closed with respect to said second panel.

5. The flexible hinge of claim 4, wherein said face plate has an offset that compensates for the thickness of said first and second brackets such that said first panel and said second panel are flush when said respective edges of each are adjacent to one another.

6. The flexible hinge of claim 2, wherein said flexible pin is a spring.

7. The flexible hinge of claim 2, wherein said flexible pin is a spring having a flexible insert to increase the shear strength of said spring.

8. The flexible hinge of claim 2, wherein said flexible pin includes a coil spring and a core pin, said core pin being inserted into said coil spring to increase the shear strength of said coil spring.

9. The flexible hinge of claim 8, wherein said core pin is plastic.

10. The flexible hinge of claim 8, wherein said flexible pin is plastic.

11. A complex contoured marine vehicle windshield having door panel pivotally mounted to an opening in said windshield by a flexible hinge assembly, said flexible hinge assembly comprising:

first and second hinge brackets, said first hinge bracket being mounted to said door panel and said second hinge bracket being mounted to said windshield, said hinge brackets having adjoining openings;

a flexible pin received within said adjoining openings to interconnect said first and second brackets permitting said brackets to pivot with respect to one another, said flexible pin bending as said brackets pivot permitting said brackets to deflect with respect to one another along the longitudinal centerline of said adjoining openings;

whereby said door panel can freely pivot with respect to said windshield.

12. The windshield of claim 11, wherein said door panel and said opening in said windshield have adjoining edges, said adjoining edges being enclosed within first and second channels having the same general contour as said edges, said first and second brackets being mounted to said first and second channels.

13. The windshield of claim 12, wherein said first channel is mounted to the edge of said door panel and includes a face plate that covers said first and second brackets when said door panel is closed with respect to said windshield.

14. The windshield of claim 13, wherein said face plate has an offset that compensates for the thickness of said first and second brackets such that said door panel is flush with said windshield when said door panel in closed.

15. The windshield of claim 11, wherein said flexible pin is a spring.

16. The windshield of claim 11, wherein said flexible pin is a spring having a flexible insert to increase the shear strength of said spring.

17. The windshield of claim 11, wherein said flexible pin includes a coil spring and a core pin, said core pin being inserted into said coil spring to increase the shear strength of said coil spring.

18. The windshield of claim 17, wherein said core pin is plastic.

19. The windshield of claim 17, wherein said flexible pin is plastic.

20. The windshield of claim 11, wherein said brackets pivot relative to said flexible pin.

21. The windshield of claim 11, wherein said adjoining openings are defined by knuckles on said hinge brackets having an interior bore, and said flexible pin is received within said interior bores of each of said knuckles.

22. A flexible hinge for mounting a first panel to a second panel with both said first and second panels having a complex contoured surface, said flexible hinge comprising:

first and second hinge brackets, said first hinge bracket being mounted to said first panel and said second hinge bracket being mounted to said second panel, said hinge brackets having adjoining openings;

a flexible pin received within said adjoining openings to interconnect said first and second brackets permitting said brackets to pivot with respect to one another, said flexible pin bending as said brackets pivot permitting said brackets to deflect with respect to one another along the longitudinal centerline of said adjoining openings;

said flexible pin including a coil spring and a core pin, said core pin being inserted into said coil spring to increase the shear strength of said coil spring.

23. A flexible hinge as recited claim 22, wherein said brackets pivot relative to said flexible pin.

* * * * *